US008006961B1

(12) United States Patent
Rutstein

(10) Patent No.: US 8,006,961 B1
(45) Date of Patent: Aug. 30, 2011

(54) APPARATUS AND METHOD FOR TREATING PROCESS FLUID

(76) Inventor: Alex Rutstein, Oberlin, OH (US)

( * ) Notice: Subject to any disclaimer, the term of this patent is extended or adjusted under 35 U.S.C. 154(b) by 683 days.

(21) Appl. No.: 12/155,027

(22) Filed: May 29, 2008

Related U.S. Application Data

(60) Provisional application No. 60/932,296, filed on May 30, 2007.

(51) Int. Cl.
*B01F 3/04* (2006.01)

(52) U.S. Cl. ..... 261/76; 261/78.2; 239/DIG. 7

(58) Field of Classification Search ..... 261/76, 261/78.1, 78.2, 115, 116, DIG. 12; 239/DIG. 7
See application file for complete search history.

(56) References Cited

U.S. PATENT DOCUMENTS 1,055,210 A * 3/1913 Morison ..... 417/167
3,685,614 A * 8/1972 Coanda et al. ..... 181/256
3,817,685 A * 6/1974 Joannes ..... 431/116
4,332,529 A * 6/1982 Alperin ..... 417/54
4,448,354 A * 5/1984 Reznick et al. ..... 239/265.17
7,354,029 B1 4/2008 Rutstein

* cited by examiner

*Primary Examiner* — Scott Bushey
(74) *Attorney, Agent, or Firm* — Fay Sharpe LLP

(57) ABSTRACT

In an improvement of the apparatus and method disclosed in U.S. Pat. No. 7,354,029 B1, a Process Fluid Treating Apparatus includes an ejector assembly fluidically connected to a process fluid supply assembly. A Coanda airfoil is located in the ejector assembly. Primary fluid is injected into the ejector duct and forms a Coanda layer, flowing adjacent to the walls of a Coanda Airfoil. A process fluid, or part of it, flows toward the ejector assembly through the Process Fluid Supply Assembly, which forces the process fluid to flow through a plurality of fluid ports to separate that process fluid into a plurality of separate streams and turns those separate streams of process fluid through its perforated tip towards the Coanda layer whereby the contact between the process fluid and the Coanda layer is controlled. Shear and other forces and pressure gradients associated with the Coanda layer serve to transport the process fluid from the source and to operate on the process fluid to atomize the process fluid and/or to de-agglomerize solid particles entrained in the process fluid. Alternatively, a mechanical pump could be used for process fluid delivery to the Coanda layer.

9 Claims, 11 Drawing Sheets

APPARATUS AND METHOD FOR TREATING PROCESS FLUID

CROSS REFERENCE TO RELATED APPLICATIONS

The present Application claims priority of Provisional Application Ser. No. 60/932,296, filed by Alex Rutstein & Associates, on May 30, 2007, titled "Process Fluid Treating Apparatus." The disclosure of the just-mentioned Provisional Application is fully incorporated herein by reference.

TECHNICAL FIELD OF THE INVENTION

The present invention relates to the general art of fluid handling and fluid treating, and to the particular field of means and methods for pumping, atomizing fluids, and/or de-agglomerizing solids in mixtures of fluids and/or mixtures of fluids and solids.

BACKGROUND OF THE INVENTION

Many industrial processes require treating a mixture of fluids and/or fluids and solids. Treatment of a fluid, a mixture of fluids, or a mixture of fluids and solids can be in the form of atomizing the liquid or de-agglomerizing solids carried by the fluid. Current means and methods for effecting such treatment include atomizing nozzles and vibration. The art includes several examples of equipment using these mechanisms and processes. While some of the known equipment is effective, many forms of such equipment have high power requirements as well as other drawbacks. Moving parts, that some of this equipment have, may cause various problems. Some equipment may be costly due to several factors, including high initial cost, maintenance, and the like. Cost problems may be exacerbated if the equipment is inefficient, especially if the equipment has low capacity.

If the equipment is large and/or bulky, the cost factors may be even further worsened by large space requirements. Equipment does exist for producing aerosols including air and fluid droplets. However, no such equipment is only capable of producing liquid droplets of predominantly (over 95%) submicron size.

In addition, many industrial processes require pumping the fluids, or mixtures of fluids and solids, from respective sources to the processing apparatus. Negative suction head is often used for fluids and/or fluids/solids mixtures transportation. Current means for forming negative suction heads include vacuum pumps and flow ejectors. Vacuum pumps have high energy requirements and are known to be heavy, bulky and expensive to operate. Flow ejectors could be relatively small and inexpensive but are capable of providing only small suction head at moderate (≦30 psig) primary fluid pressure.

Therefore, there is a need for an efficient and reliable means and method for atomizing and/or de-agglomerizing fluids, or solids in mixtures of fluids and solids combined with an efficient and reliable means and method for transporting such mixtures from a source or sources to the area where they are appropriately processed. A need exists for aerosol generators that produce only submicron size droplets, and especially generators providing high submicron droplet capacity, such as an equivalent of a liter per minute or higher.

The inventor's U.S. Pat. No. 7,354,029 B1 of Apr. 8, 2008 covered one possible approach to addressing the above need. The disclosure of U.S. Pat. No. 7,354,029 B1 is fully incorporated herein by reference. Treating the process fluids according to the teaching in this Patent is realized by coflowing motive air which is known as "compressed air," (or any other gas), or "primary air," and process fluid in a specially profiled annular channel. According to the teaching of the above patent, the fluid, flowing parallel to a Coanda Layer, formed inside a Coanda Ejector, provides an interaction between the rapidly moving air and the much slower moving process fluid. According to the above patent, the application of the shear forces operating at the outside boundary of the Coanda Layer are proportional to a large velocity gradient existing between the motive air and the process fluid, and these forces and gradients shear the process fluid into small droplets. The latter droplets thus formed mix with the atmospheric air, sucked in through an Atmospheric Tube, as well as with the motive air, and forms an aerosol.

While the apparatus and process disclosed in the incorporated patent work well, there is still room for improvement:

For example: due to the presence of partial vacuum in the above channel, as well as the shear forces, the continuity of the contact between the shearing air and the process fluid can be improved. Consequently, the efficiency of the shearing process could be raised by reducing the motive air-to-process fluid mass flow ratio.

The goal of creating a steady flow of predominantly submicron droplets can be better achieved by improving the continuity and reliability of the air/fluid contact.

If the number and position of areas of air/fluid interaction inside the above channel could be increased to become less random, the average droplet size contained in the aerosol would become smaller, thus broadening the area of application of the Apparatus and Method for Treating Process Fluid, said Apparatus being built according to the above U.S. Pat. No. 7,354,029, B1.

The design of the above Apparatus can be simplified and made more efficient by reducing the distance and number of parts located between the fluid intake and the inlet into the above air/process fluid channel.

The better geometrical uniformity of the air/fluid contact areas can be improved to reduce or eliminate the random nature of fluid droplet size distribution in the aerosol.

The inventor conducted a vast amount of additional work directed to improving the performance of the apparatus and method disclosed in the incorporated patent. This work included a great deal of testing and measurement of air and fluid parameters, and led to a radical design modification. A resulting improved apparatus and method forms the basis of the new invention disclosed herein.

OBJECTS OF THE INVENTION

The main object of the present invention is to improve the apparatus and method disclosed in the incorporated U.S. Pat. No. 7,354,029.

Another object of the present invention is to provide an efficient and reliable means and method for de-agglomerizing solids carried by a fluid or by a mixture of fluids.

Another object of the present invention is to provide an efficient and reliable means and method for atomizing fluids.

Another object of the present invention is to provide an efficient and reliable means and method for exposing solid particles or solid components in a mixture of fluids and solids to high shear forces.

Another object of the present invention is to expose fluids or mixtures of fluids to high shear forces.

Another object of the present invention is to provide a high suction head for the purposes of transporting fluid or mixtures of fluids and solids from a source or sources.

SUMMARY OF THE INVENTION

These, and other objects are achieved by combining a Coanda ejector with a special Process Fluid Supply Assembly so that multiple uses of the Coanda effect are utilized whereby the overall apparatus, having no moving parts, is efficient, simple and reliable. Specifically, the Coanda ejector is used to pump a process fluid, a fluid mixture, or a fluid mixed with solids from a source or sources through the special Process Fluid Supply Assembly into an ejector duct, and to operate on at least one of the fluid components.

The basic idea of the present invention improves the operation and results obtained by the device disclosed in the incorporated patent by substituting a well organized fluid delivery through a specially developed Process Fluid Supply Assembly in place of a coflow of air and fluid. In this alternative design, the Process Fluid Supply Dispenser can be viewed as acting in the manner of a showerhead, having multiple openings that provide a plurality of separate and uniform streams of fluid around the circumference of the Fluid Supply Dispenser. The position of the holes in the Dispenser's adjacent hole rings are staggered to avoid overloading of the Coanda layer. The air/fluid interaction is very uniform and repeatable.

Specifically, the Process Fluid Supply Assembly, embodying the principles of the present invention, is combined with a Coanda Ejector to create a Coanda effect at boundary layer between the motive air and the fluid streams emerging from the Dispenser, shear the fluid streams into a flow of predominantly submicron droplets, and mix it with the motive air as well as flow of the atmospheric air, thus creating an aerosol. The Coanda layer not only operates on fluids, or solids in the mixture of fluids and/or fluids and solids, but it also provides partial vacuum, also called "suction head," to transport fluids and solids from a source or sources through the Process Fluid Supply Assembly into the Ejector Assembly, and operates on that fluid by exposing such fluids and/or solid particles to the forces associated with the Coanda layer.

The means and method embodying the principles of the present invention utilize a Coanda effect in the entrance region of a Coanda ejector. The fluid layer, known as the Coanda layer, is formed by a motive fluid injected through an annular nozzle at a high velocity into the ejector inlet section. That Coanda layer associated with the Coanda effect is present, in particular, on a Coanda airfoil surface that is located between the annular Coanda nozzle exit and the ejector throat. The ejector based on the Coanda effect will be referred to as a Coanda ejector. Generally, secondary fluid includes process fluid, as well as, where applicable atmospheric air sucked in, or "induced" through the Atmospheric Tube by the ejector suction head. According to the present disclosure, the Coanda ejector is fluidically connected to the source or sources of the process fluid through its inlet port as well as to the atmosphere through an Atmospheric Tube. The process fluid passes through a Process Fluid Supply Dispenser. The atmospheric air comes through an Atmospheric Tube into the middle area of the Ejector duct, unoccupied by the Process Fluid Supply Assembly elements. The combination of the Coanda ejector and the Process Fluid Supply Assembly utilizes the forces and pressure gradients associated with the Coanda effect in the ejector to achieve several simultaneous results: transporting the process fluid from a source or sources to the Coanda ejector; operating on the process fluid as it passes through the ejector and/or operating on some or all of the materials carried by the process fluid.

The Coanda effect is established by forcing a motive fluid through an annular nozzle into a specially profiled airfoil forming the inlet section of the ejector duct. Process fluid is induced into the ejector duct under the influence of the suction head, typically established in the inlet section of the Coanda ejector. The process fluid is smoothly guided by the Process Fluid Supply Assembly into the ejector duct area where at the Coanda forces and pressure gradients are applied to the process fluid in an efficient, repeatable, and reliable manner. The process fluid flowing from the Process Fluid Supply Assembly is controlled and well defined so the interaction between the process fluid and the Coanda Layer, formed by the motive air, is efficient, repeatable and reliable.

Alternatively, when higher pressure gradients than those provided by Coanda layer are required, a mechanical pump can be used to transport or assist in the transporting of the process fluid from the source or sources to the ejector duct.

Thus the apparatus and method embodying the present invention achieves many goals, including (but not limited to):

A. As compared to the apparatus and method disclosed in the incorporated patent, the air/process fluid ratio is significantly reduced, thus increasing the Apparatus efficiency.

B. As compared to the apparatus and method disclosed in the incorporated patent, the uniformity of the fluid streams around the circumference of the air/fluid channel produced by the Dispenser improves the uniformity of the fluid shearing process, and thus, the uniformity of the droplet size distribution.

C. As compared to the apparatus and method disclosed in the incorporated patent, the flexibility of the Fluid Dispenser design is improved thereby permitting the apparatus and method embodying the present invention to more precisely vary the droplet size distribution by changing the diameter of holes, distance between the holes, the number of hole rings in the Dispenser, and the distance between the rings.

D. As compared to the apparatus and method disclosed in the incorporated patent, the process fluid flow could be varied by the means listed above, as well as by the fluid supply pressure.

The extensive testing of the Process Fluid Treating Apparatus Prototype embodying the principles of the present invention has confirmed all the above aspects of its operation as improving the performance of the apparatus and method disclosed in the incorporated, U.S. Pat. No. 7,354,029 B1.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

Figure 2:
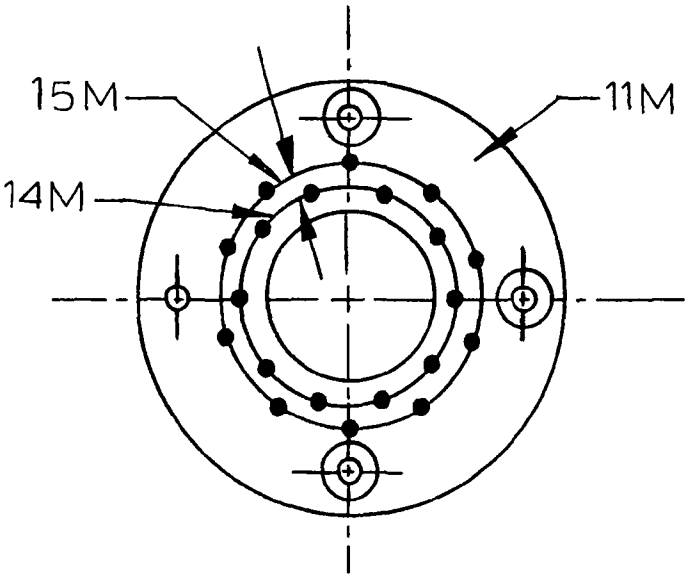
FIG. 2 is a top plan view and a side elevational view of a Process Fluid Supply Dispenser.
Figure 2C:
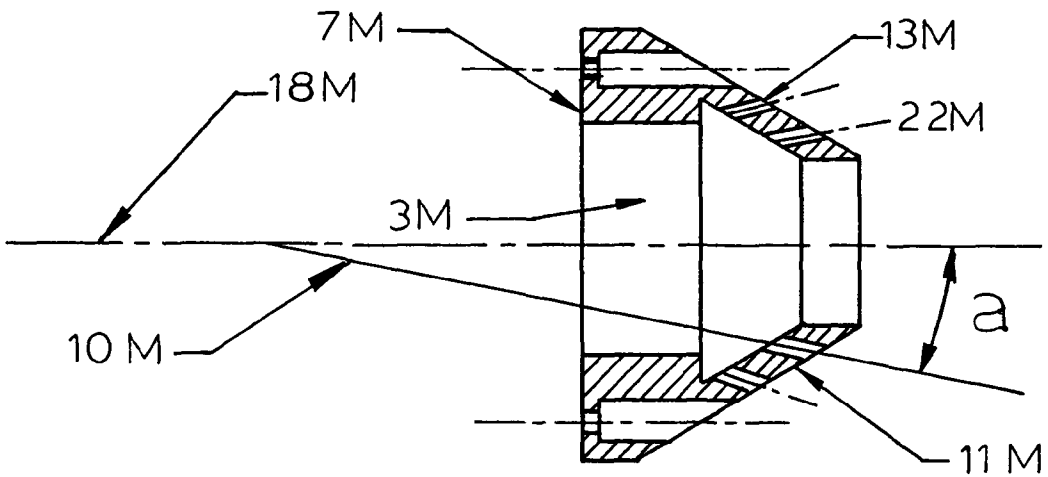
Figure 2A:
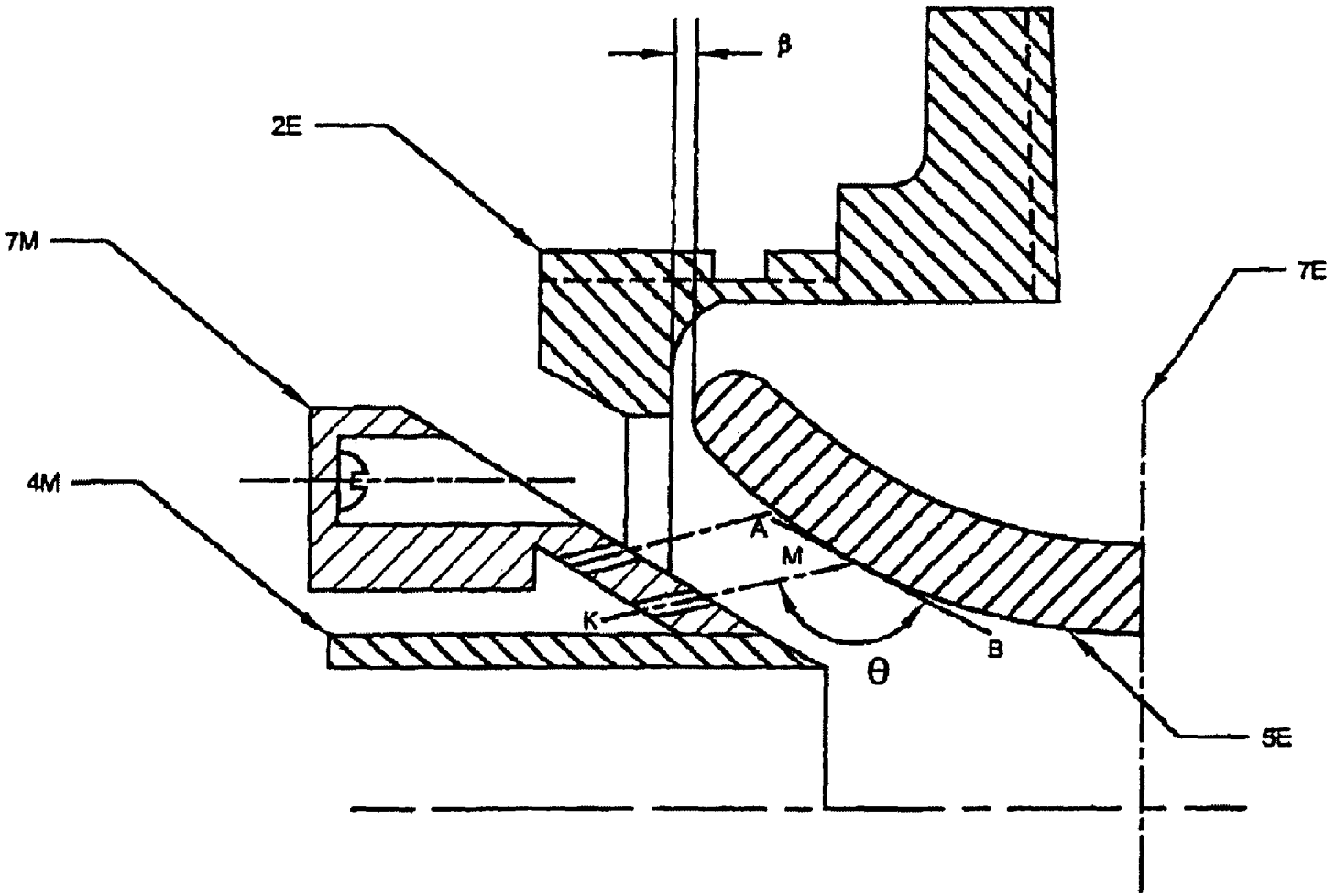

FIG. 2*a* is a side elevational view of the Process Fluid Supply Dispenser, a part of the Ejector Housing, and part of Coanda Airfoil.

Figure 2B:
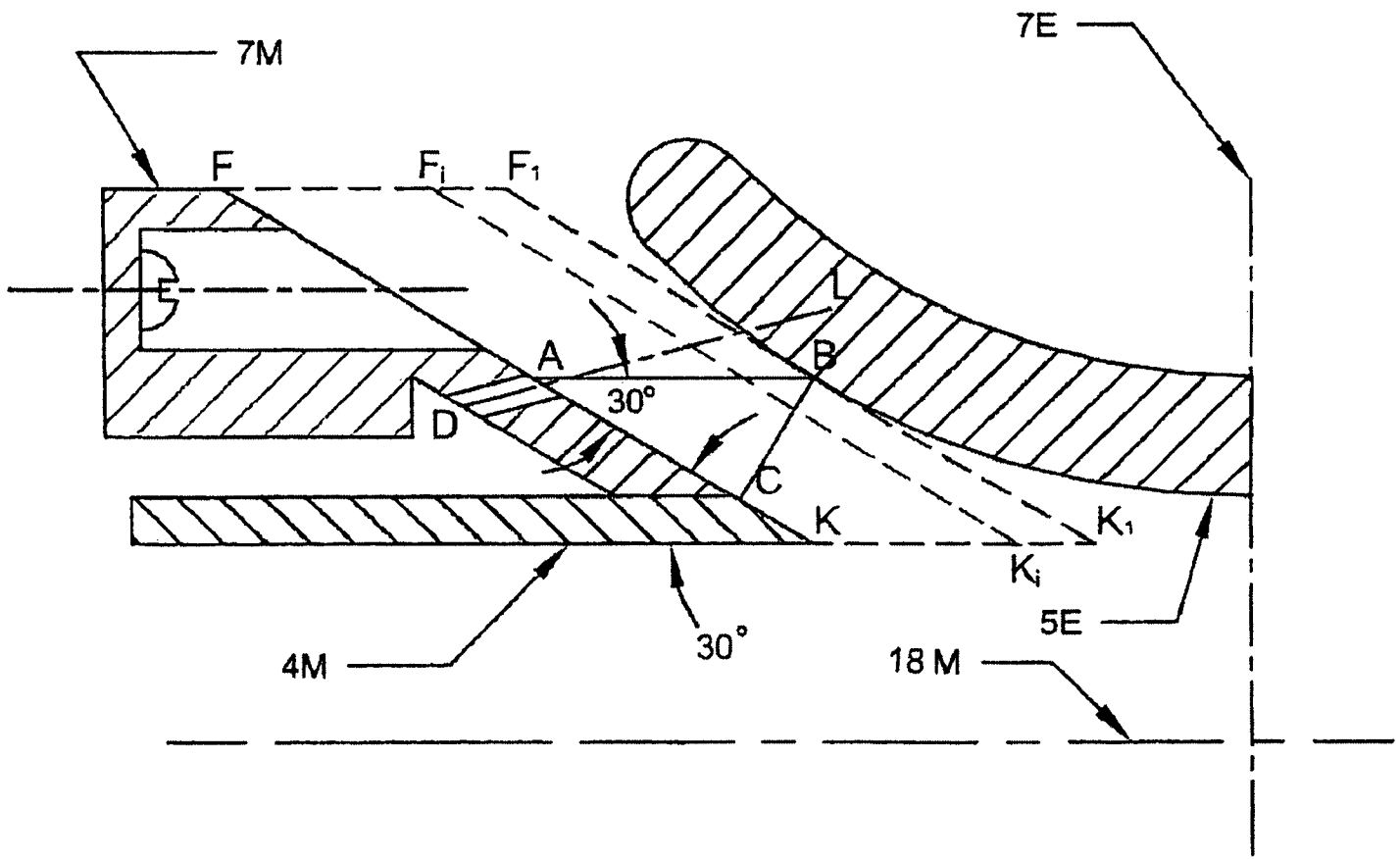

FIG. 2*b* is a side elevational view of the Process Fluid Supply Dispenser and Coanda Airfoil Element.

FIG. 2*c* is a cutaway side elevational view of the Process Fluid Supply Dispenser shown in FIG. 2.

Figure 3:
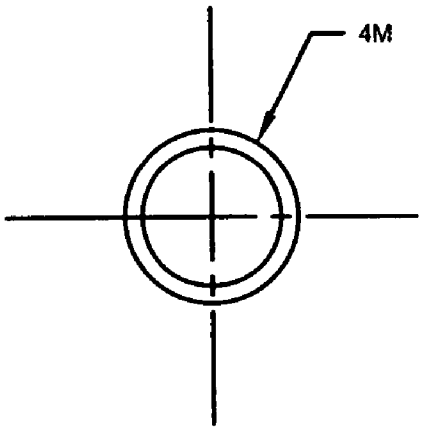

FIG. 3 is a top plan view and side elevational view of the Atmospheric Tube.

Figure 3A:
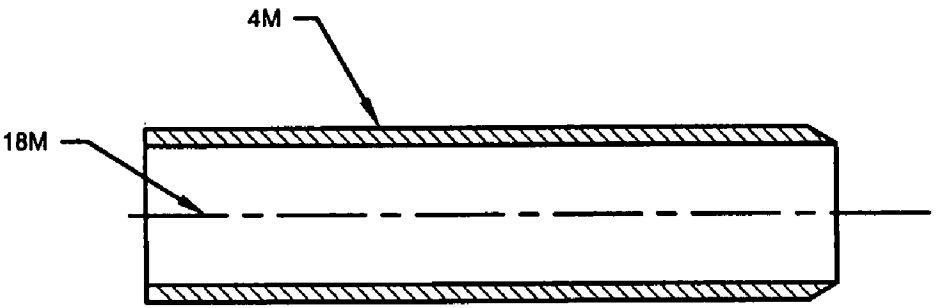

FIG. 3*a* is a cutaway side elevational view of the Atmospheric Tube shown in FIG. 3.

Figure 4:
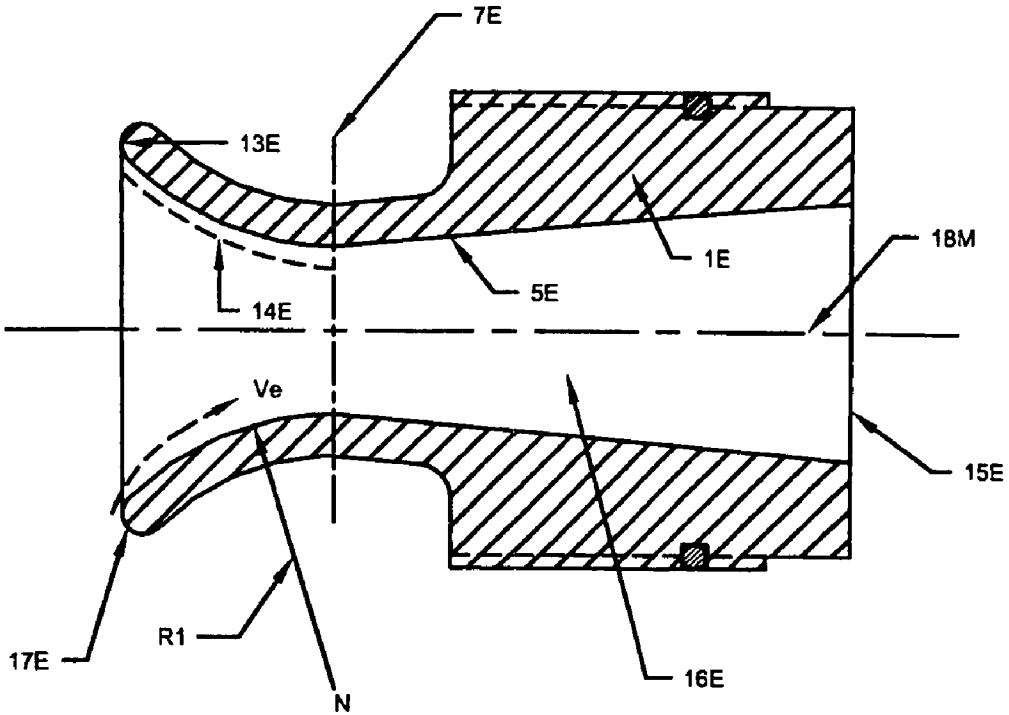

FIG. 4 is a top view and side elevational view of the Coanda Airfoil Element.

Figure 4A:
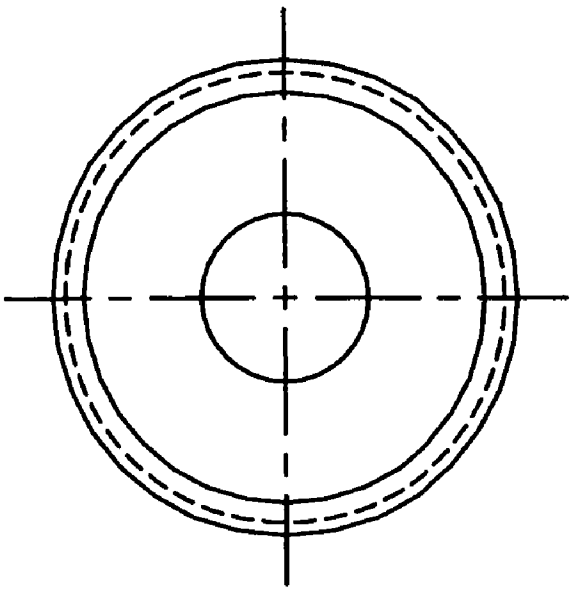

FIG. 4*a* is an end elevational view of the Coanda Airfoil Element shown in FIG. 4.

Figures 5, 5A:
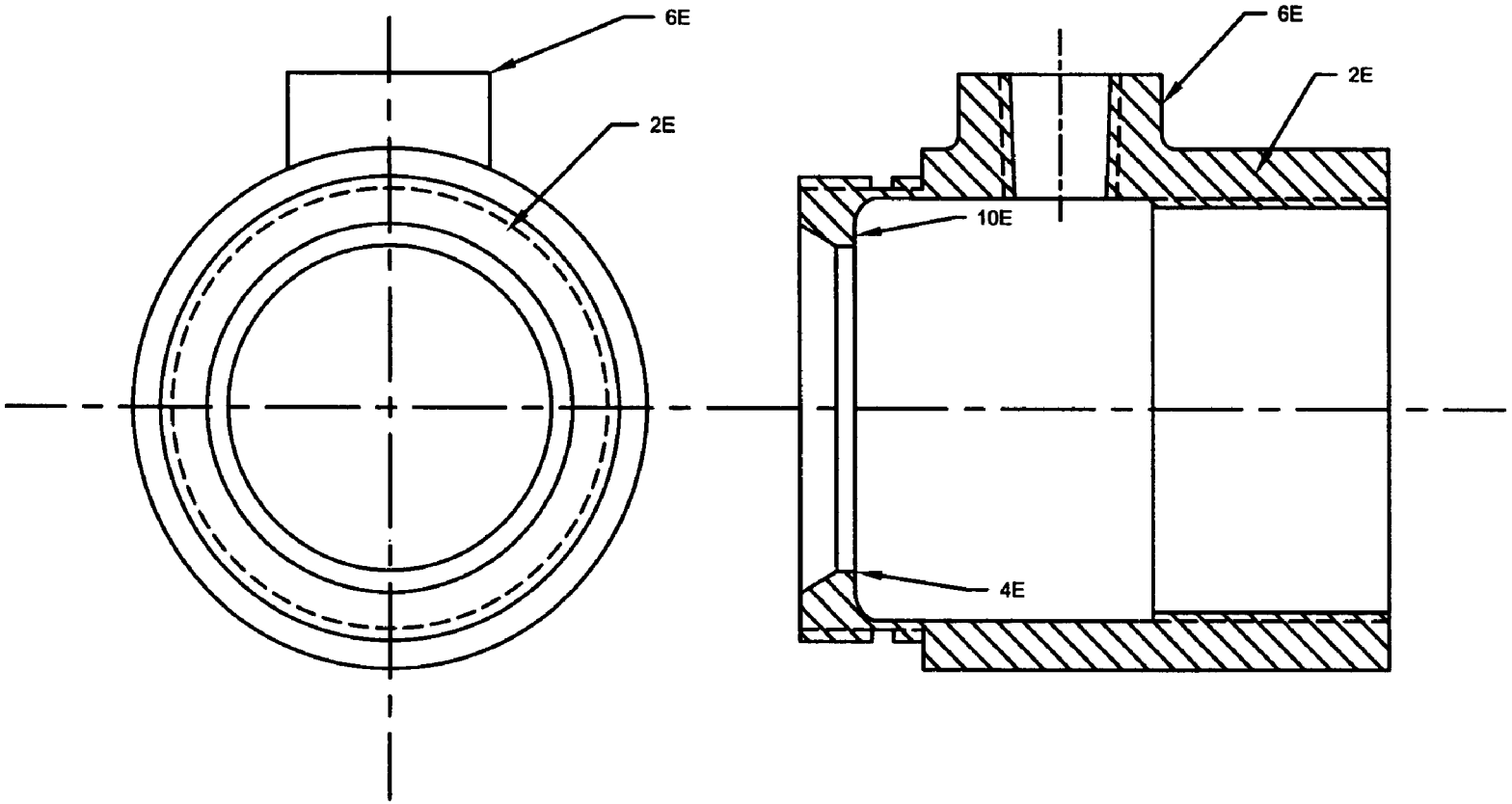

FIG. 5 is a downstream view and a side elevational view of the Ejector Housing.

FIG. 5*a* is an end elevational view of the ejector housing shown in FIG. 5.

Figures 6, 6A:
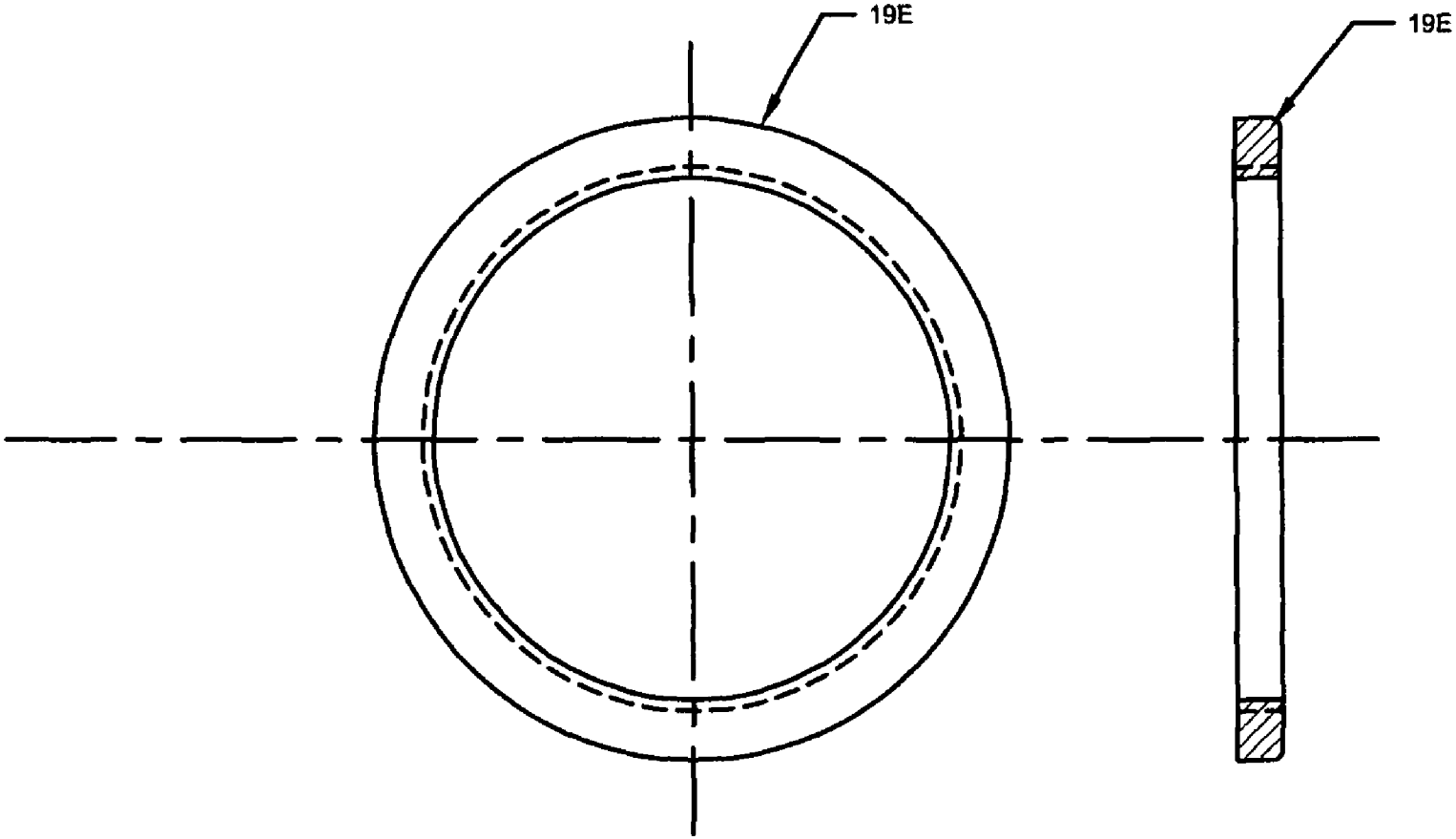

FIG. 6 is a downstream view and side elevational view of the Locking Ring of the Ejector Housing.

FIG. 6*a* is an end elevational view of the locking ring shown in FIG. 6.

Figure 7:
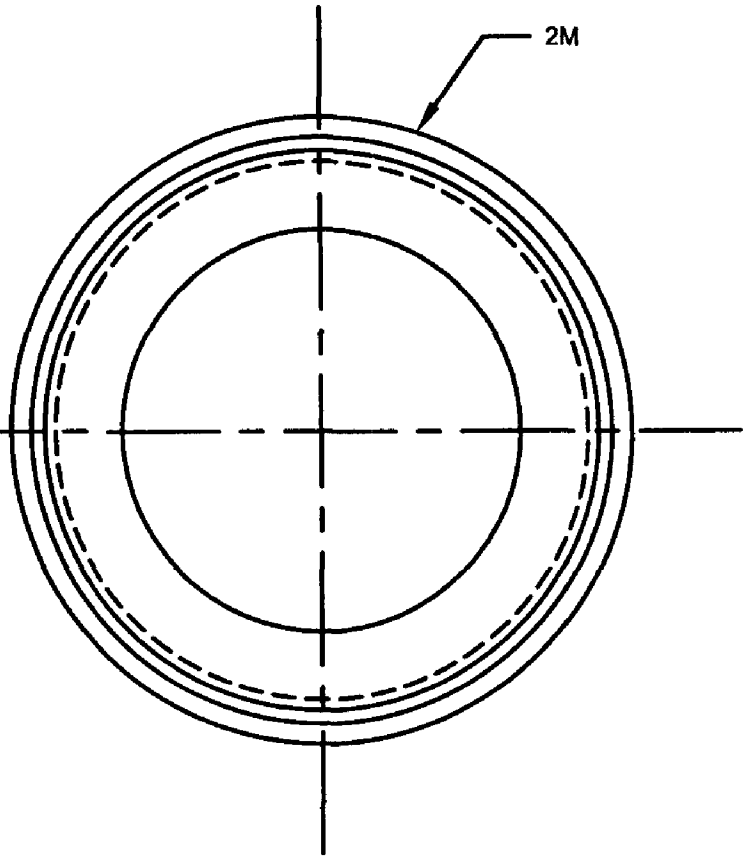

FIG. 7 is a top view and a side elevational view of the Process Fluid Supply Assembly 8.

Figure 7A:
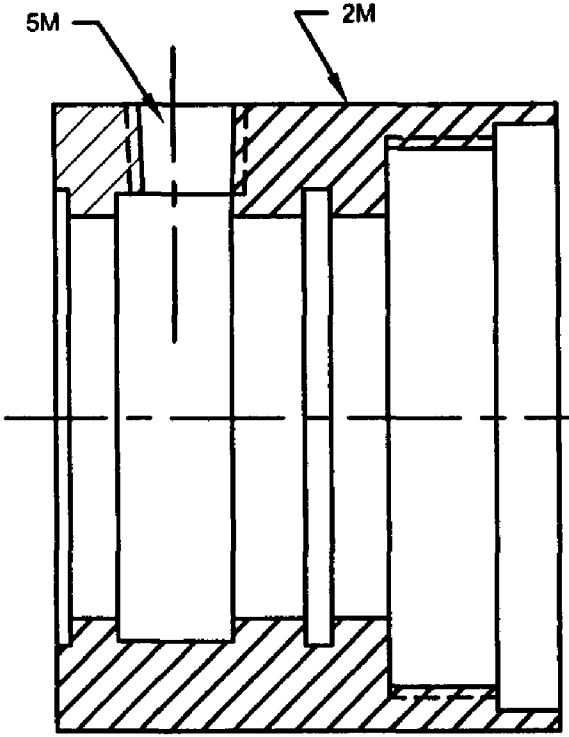

FIG. 7*a* is a cutaway view of the Process Fluid Supply Assembly shown in FIG. 7.

Figures 8, 8A:
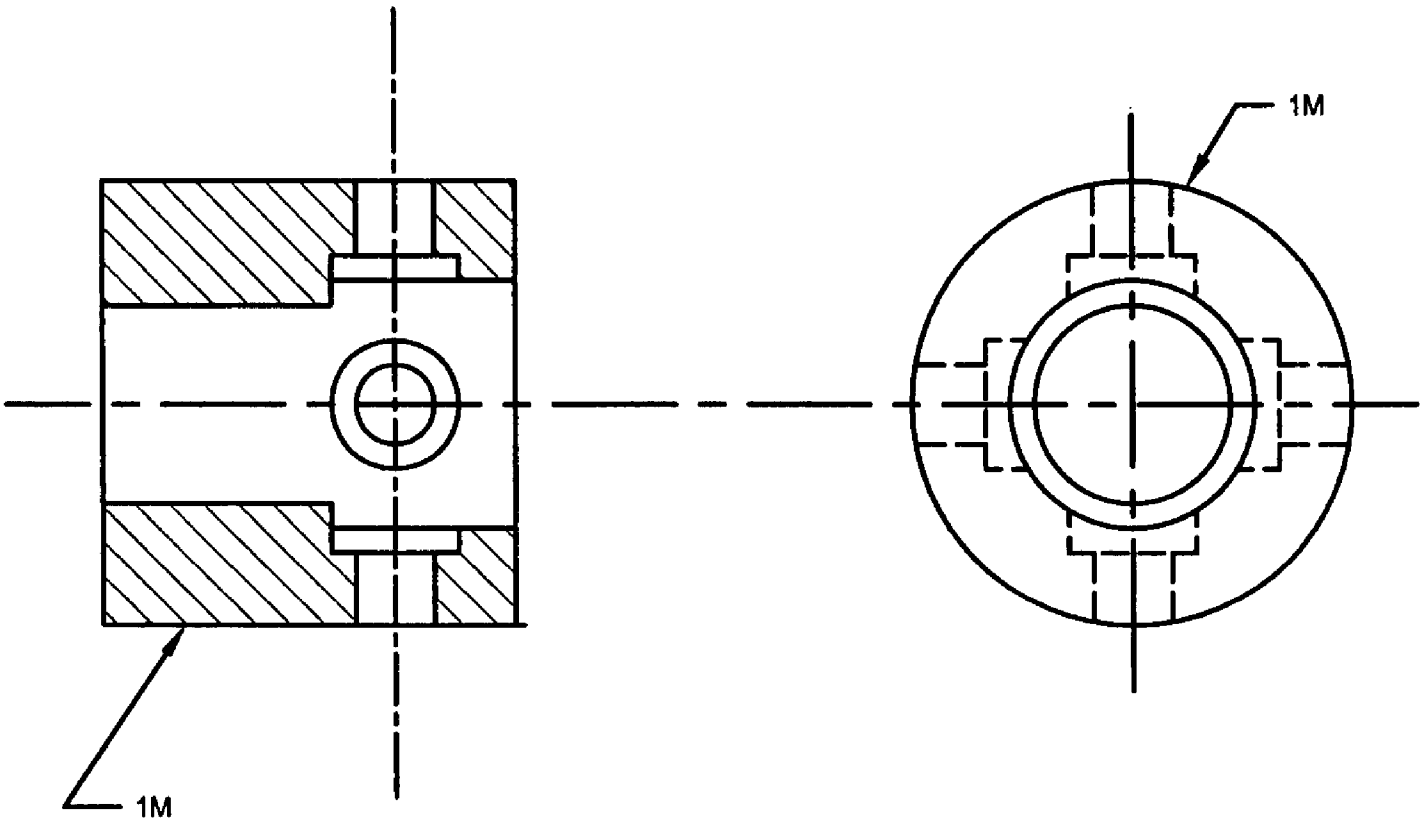

FIG. 8 is a top view and side elevational view of the Housing of the Process Fluid Delivery Assembly.

FIG. 8*a* is a cutaway view of the Housing shown in FIG. 8.

Figures 9, 9A:
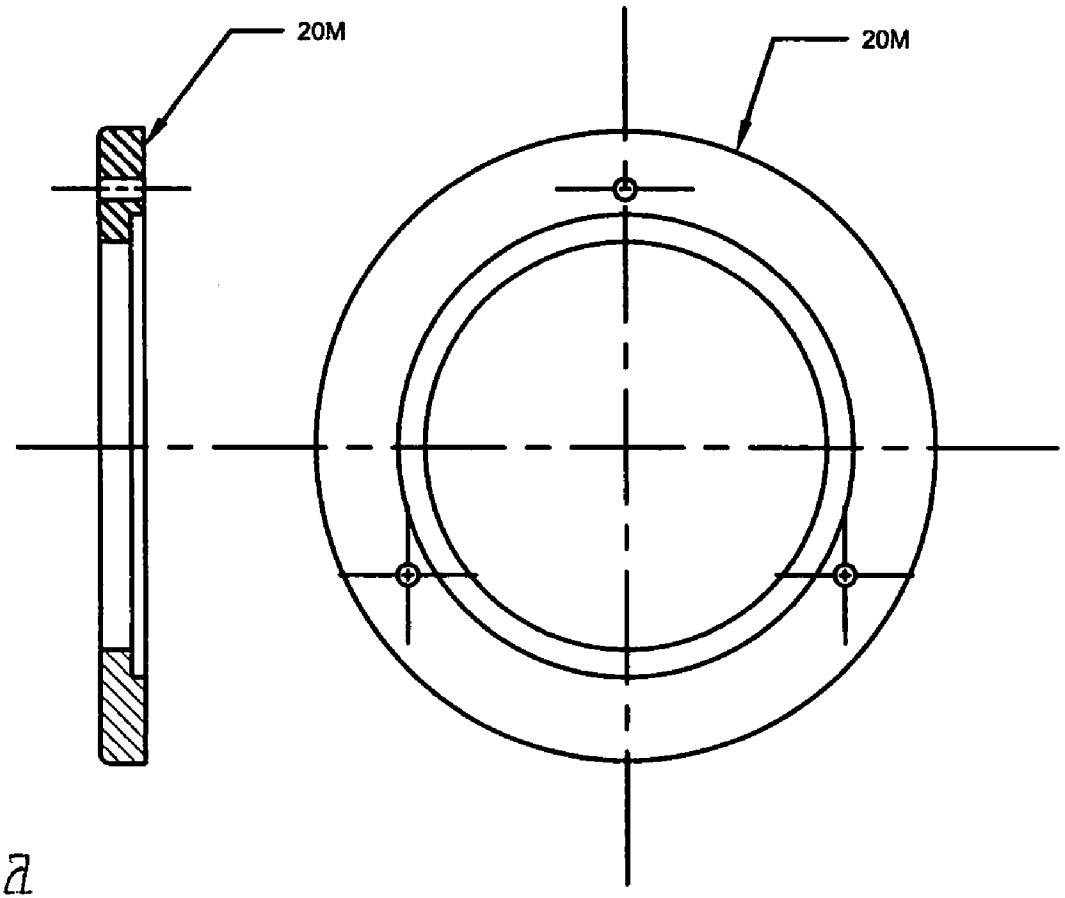

FIG. 9 is a downstream view and side elevational view of the Locking Ring of the Process Fluid Supply Assembly.

FIG. 9*a* is a cutaway side elevational view of the Locking Ring shown in FIG. 9.

DESCRIPTION OF THE PREFERRED EMBODIMENT OF THE INVENTION

Figure 1:
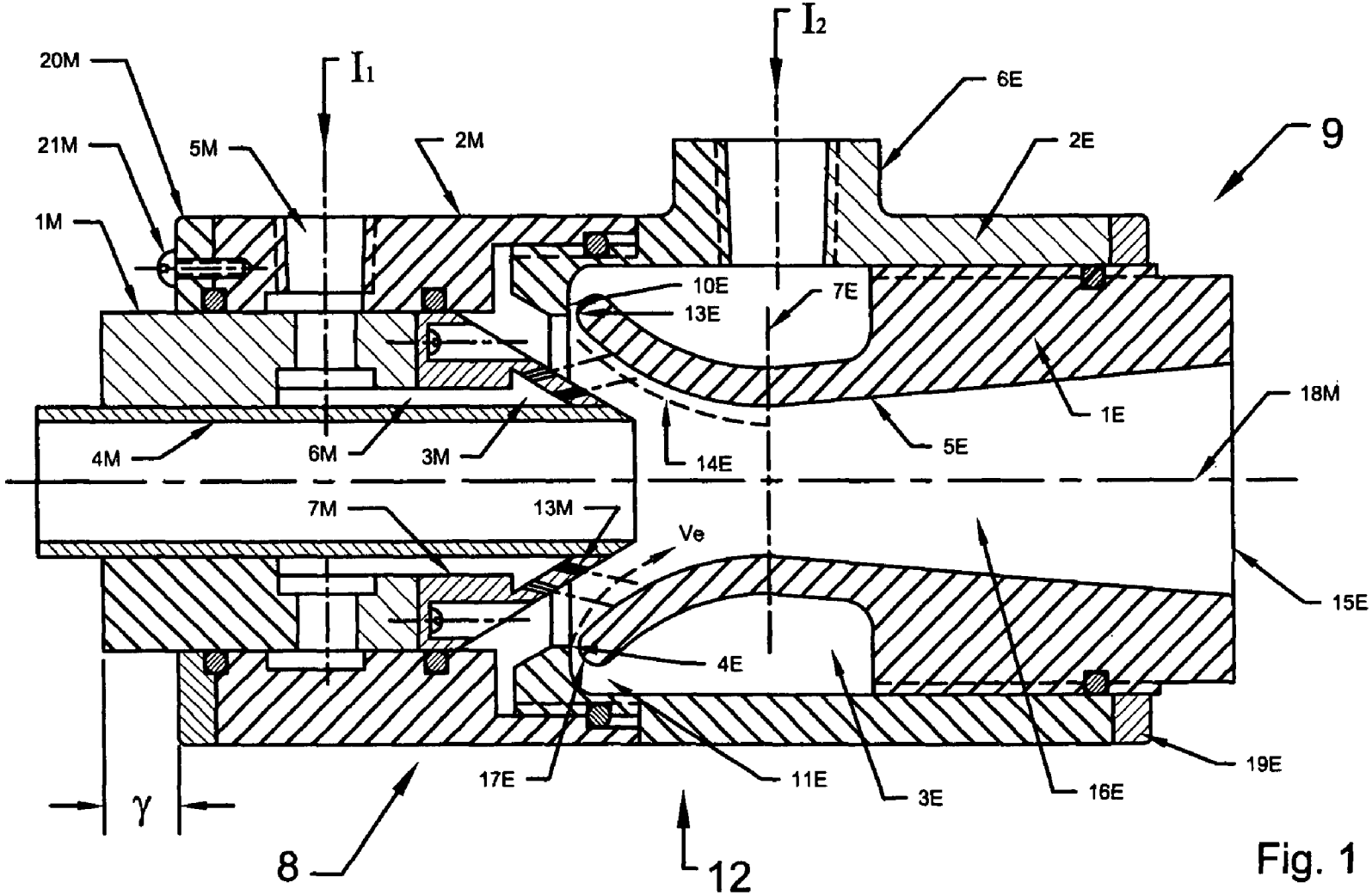
FIG. 1 is a side elevational view, partially cut away, embodying the principles of the present invention as including a Coanda Ejector fluidically connected to a special Fluid Supply Assembly.

As shown in FIG. 1, the Apparatus for Process Fluid Treating 12 embodying the principles of the present invention includes a Coanda Ejector assembly 9 fluidically connected to the Process Fluid Supply Assembly 8, with the process fluid, a mixture of process fluids, and/or a mixture of process fluids and solids flowing into the Process Fluid Supply Assembly 8 in direction $I_1$.

After entering the inlet port 5M, the process fluid first, is directed to flow radially, towards the annular fluid passageway 6M, then is directed to flow parallel to centerline 18M of the Apparatus for Treating Process Fluid 12 and then is further directed to turn into Process Fluid Supply Chamber 3M. From the chamber 3M, the process fluid flows through a plurality of perforated holes 13M (see FIG. 2), forming separate streams flowing towards Coanda layer 14E.

It is recommended that the perforated holes 13M (FIG. 2) are made perpendicular to the Dispenser's 7M semi-conical wall 11M for convenience of their fabrication. However, those skilled in the art will recognize that larger than 90° angles for holes drilled in the direction of the Coanda layer flow, such as an angle formed between a Dispenser hole centerline KM and a tangent AB to the point M of intersection of the above centerline KM with the Coanda airfoil 5E, FIG. 2*a*

Those skilled in the art would further recognize that certain advantages may be provided using hole centerlines, such as KM in FIG. 2*a*, that form an angle θ>90° between the centerline KM and the tangent to the point M of intersection between line KM and the Coanda Airfoil 5E, FIG. 2*a*. For instance, fluid streams crossing the Coanda boundary layer have, at the angles θ>90°, form "imprints," or a cross section areas larger than do the streams moving at 90° angle to the Coanda Airfoil. Depending on the airfoil geometry, such larger "imprints" could therefore increase the area of interaction between the much slower streams of fluid and the rapidly moving Coanda boundary layer, which may result in the nozzle operation improvement. Ejector Assembly 9 includes a housing 2E, a planar section 10E of which, along with Coanda Airfoil Component's 1E upstream tip 17E, forms Coanda Annular Nozzle 4E, having a throat at the position 13E. The inlet section of the ejector duct, formed the Coanda annular airfoil 5E, converges in the direction of motive fluid flow from Coanda Nozzle 4E to the ejector throat location 7E, and an outlet section of the airfoil 5E diverges in the direction of fluid flow from the ejector throat location 7E to the ejector exit 15E.

Coanda Ejector Assembly 9 is fluidically connected to a source of primary fluid, such as compressed air or other gas, through primary fluid supply nozzle 6E. The supply nozzle 6E is fluidically connected to a source of high pressure primary fluid at its inlet and is fluidically connected to the ejector's annular chamber 3E at its outlet port 11E.

The high pressure primary fluid flows from its source or sources towards the process flow supply nozzle 6E in the direction $I_2$, and, further on, from the ejector chamber 3E, through the Coanda Nozzle 4E, into the ejector duct 16E, with a velocity $V_e$. As was discussed above, fluid issuing from a Coanda nozzle, such as nozzle 4E, forms an annular Coanda layer 14E flowing adjacent to the Ejector's Airfoil Wall 5E. Under the principles of Coanda effect, the layer 14E creates shear forces and pressure gradients.

In the Apparatus for Treating Process Fluid 12, the shear forces and pressure gradients associated with Coanda layer are used to achieve simultaneously the purposes of pumping, transporting the process fluid or fluid/solid mixture from a source or sources to and through the Process Fluid Supply Assembly 8, and operating on the fluid and/or solid.

The pressure gradients associated with the Coanda layer develop suction head that draws the process fluid or a fluid/solid mixture into the Process Fluid Supply Assembly 8, and thus reduces or eliminates the need for a pump to transport the process fluid from the source. In the preferred embodiment of the invention, the process fluid is directed through the exit part of the Process Fluid Supply Assembly, identified as Process Fluid Supply Dispenser 7M (see FIG. 2) extending for 360°. However, less than 360° of Dispenser 7M extensions are also possible for applications that may require higher ejector exit velocity, or for other purposes.

The Dispenser 7M and Atmospheric Tube 4M are shown in FIGS. 2 and 3. In the Preferred Embodiment of the Invention, the Dispenser 7M has two concentric rings of holes 13M (see FIG. 2) to provide an exit for the process fluid from the Process Fluid Supply Chamber 3M into the space between the semi-conical wall of the Dispenser 7M and Coanda Airfoil Component 5E. The Dispenser 7M design permits varying a few of its geometrical parameters: hole diameter; hole number in a ring; the number of hole rings; the distance between the rings, 15M, and the angle α, FIG. 2. The angle α determines the position of the centerlines 22M of the holes 13M in the ring 14M. The angle α is formed by the hole centerlines 10M and the centerline 18M of the Process Fluid Treating Apparatus 18M. In the particular example of FIG. 2, the centerlines of the holes 13 are parallel to each other. However, those skilled in the art could choose different hole configurations.

The Dispenser 7M, FIG. 2, along with the Atmospheric Tube 4M, is a part of the Process Fluid Delivery Assembly 1M, FIG. 1. It is noted that while two rings of holes are disclosed, any number of rings can be used without departing from the scope of this disclosure. Furthermore, any number of holes or other opening configurations in the semi-conical wall 11M of the Dispenser 7M can be used without departing from the scope of this disclosure. Such variations are intended to be within the scope of this disclosure and the claims appended hereto.

The Coanda nozzle's throat's 13E width β determines the motive fluid flow rate under any desired pressure level in the Ejector Chamber 3E. The throat 13E width should be typically established by rotating the airfoil element 1E relative to the Ejector Housing 2E. For convenience of the throat's 13E width β adjustment, graduations are provided on the downstream surface of the Coanda airfoil's 1E Locking Ring 19E.

In practice, the motive air pressure differential across the Coanda nozzle 4E, FIG. 1, is slightly over the critical one. Consequently, the exit velocity from the Coanda Nozzle is typically near that of sound. However, supersonic motive air velocity is also possible to maintain.

The relative position of Coanda Airfoil 5E and Dispenser's 7M semi-conical wall determines the process fluid stream lengths which have a significant influence upon the fluid droplets size produced by the interaction between the fluid streams and Coanda layer. Those skilled in the art will be able to measure indirectly the distance between Coanda Airfoil 5E and Dispenser's 7M semi-conical wall 11M. FIG. 2*b* could be helpful in considering such measurement possibilities.

In particular, there could be useful to notice that both the dispenser 7M and airfoil element 1E could move only in the horizontal direction. In addition, the easy to measure variable γ, FIG. 1, that may help to define relative position of the Process fluid Supply Assembly Housing 2M and Process fluid Delivery Assembly 1M could also be helpful to use.

The position of the atmospheric tube 4*m* relative to the fluid delivery assembly 1*m* affects the amount of atmospheric air brought by the tube into the ejector duct 16*e*. it may be necessary to adjust the atmospheric air amount to provide stable apparatus 12 operation of the apparatus 12. the tube 4*m* is not fastened to any other assembly 1*m* elements. it could be slid back and forth as desired, within limits. in case that instability of operation is detected, by sliding the tube 4*m* in either direction, a position of it could be found empirically that eliminates instability.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. An improvement in a process fluid treating apparatus which comprises a process fluid supply assembly, which includes an inlet section fluidically connected to a source of process fluid, an outlet section fluidically connected to the inlet section, and a longitudinal axis which extends between the inlet section of the process fluid supply assembly and the outlet section of the process fluid supply assembly; a Coanda airfoil assembly fluidically connected to said process fluid supply assembly and which includes a flow section, the flow section of said Coanda airfoil assembly being convex in shape to define a curved passageway through which process fluid flows, said Coanda airfoil assembly being fluidically connected to a source of motive fluid, a primary fluid outlet port defined in the flow section of said Coanda airfoil assembly and fluidically connected to the source of motive fluid so that motive fluid is injected into the passageway adjacent to said Coanda airfoil assembly forms a Coanda layer of motive fluid flowing adjacent to Coanda airfoil walls, the Coanda layer having shear forces and pressure gradients associated therewith; the outlet section of said process fluid supply assembly being located and oriented with respect to the Coanda layer to direct process fluid toward and into contact with the Coanda layer of primary fluid in a direction and manner so that the shear forces and pressure gradients associated with the Coanda layer are applied to the process fluid flowing in contact with the Coanda layer so that the shear forces and pressure gradients of the Coanda layer of motive fluid act on the process fluid to pump the process fluid from the process fluid supply assembly inlet section to the process fluid supply assembly outlet section and to turn the process fluid into small components, the improvement comprising:

a body element mounted on said process fluid assembly to be in line with the longitudinal axis of the process fluid supply assembly and to be contacted by process fluid flowing through the process fluid supply assembly and including a shaped exit section, the exit section of the body element having a conical shape with fluid ports defined there through, the body being mounted on the process fluid supply assembly to define a fluid passage fluidically connected to the holes in the exit section of the body element, the fluid passage being fluidically connected to the inlet section of the process fluid supply assembly so process fluid flows through the fluid passage to the holes in the body element, the holes in the body element being fluidically connected to the Coanda layer so process fluid flowing out of the holes in the body element contacts the Coanda layer of primary fluid to be acted thereon by the forces and gradients of the Coanda layer of primary fluid.

2. The improvement defined in claim 1 wherein the Coanda airfoil has a surface over which the Coanda layer of primary fluid flows, and each of the holes in the body element has a central axis oriented in the direction of flow of fluid through the hole, each of the holes in the body element being oriented at an angle that is between 30° and 90° with respect to a tangent plotted at the point of intersection of the axis of any hole and the surface of the Coanda airfoil, in the direction of the Coanda Layer flow.

3. The improvement defined in claim 2 wherein there are two concentric rings of holes defined in the body element.

4. The improvement defined in claim 2 wherein the axis of any hole in the body element forms an oblique angle with respect to the longitudinal axis of the process fluid supply assembly.

5. The improvement defined in claim 1 wherein the body element is movably mounted on the process fluid supply assembly to be movable in the direction of the longitudinal axis of the process fluid supply assembly.

6. The improvement defined in claim 1 wherein the process fluid includes liquid particles entrained therein.

7. The improvement defined in claim 1 wherein the process fluid includes solid particles entrained therein.

8. The improvement defined in claim 1 wherein said primary fluid has a flow velocity and said process fluid has a flow velocity, with said primary fluid flow velocity exceeding the process fluid flow velocity by over two orders of a magnitude.

9. The improvement defined in claim 1 wherein said Coanda airfoil assembly is annular and extends for 360 degrees about an axis of a process fluid treating apparatus centerline.

* * * * *